US006405572B1

(12) United States Patent
Seamans

(10) Patent No.: US 6,405,572 B1
(45) Date of Patent: Jun. 18, 2002

(54) LOCKING APPARATUS FOR A KEY HOLDER

(75) Inventor: Mitchell E. Seamans, Cumberland, RI (US)

(73) Assignee: A.T.X. International, Inc., Lincoln, RI (US)

( * ) Notice: Subject to any disclaimer, the term of this patent is extended or adjusted under 35 U.S.C. 154(b) by 3 days.

(21) Appl. No.: 09/694,856

(22) Filed: Oct. 24, 2000

(51) Int. Cl.[7] ..... A47G 29/10

(52) U.S. Cl. ..... 70/456 R; 24/3.6; 70/459; 206/37.1; 401/52; 401/195; 403/322.1

(58) Field of Search ..... 70/456 R, 459, 70/460; 206/37.1, 37.8, 38.1; 24/3.6, 3.11, 324, 662; 401/52, 195; 403/315, 322.1, 325, 326, 329, 297

(56) References Cited

U.S. PATENT DOCUMENTS

| | | | | | |
|---|---|---|---|---|---|
| 839,047 | A | * | 12/1906 | Sylvester | 24/625 |
| 1,278,783 | A | | 9/1918 | Stoner | |
| 1,484,532 | A | | 2/1924 | Quigley | |
| 1,509,570 | A | * | 9/1924 | Sykes | 70/456 R |
| 2,599,660 | A | | 6/1952 | Poutinen | |
| 2,845,672 | A | * | 8/1958 | Molene | 24/606 X |
| 3,362,201 | A | | 1/1968 | Lachin | |
| 3,599,457 | A | * | 8/1971 | Kamp | 70/459 |
| 3,621,690 | A | | 11/1971 | Whitcomb | |
| 3,853,416 | A | * | 12/1974 | Hanan | 403/322.1 |
| 4,392,279 | A | | 7/1983 | Schwager | 24/221 R |
| 4,407,148 | A | | 10/1983 | Rousseau | 70/456 R |
| 4,713,951 | A | | 12/1987 | Ros | 70/456 R |
| 4,716,633 | A | | 1/1988 | Rizo | 24/453 |
| 4,984,442 | A | | 1/1991 | Benson | 70/456 R |
| 5,031,430 | A | | 7/1991 | Nelson | 70/456 R |
| 5,058,405 | A | * | 10/1991 | Stillwagon | 70/456 R |
| 5,209,090 | A | * | 5/1993 | Stillwagon | 70/456 R |
| 5,363,680 | A | | 11/1994 | Wu | 70/456 R |
| 5,457,976 | A | * | 10/1995 | Stillwagon | 70/456 R |
| 5,651,632 | A | * | 7/1997 | Gordon | 403/329 X |
| 5,937,680 | A | * | 8/1999 | Parsons | 70/456 R |
| 5,947,509 | A | * | 9/1999 | Ricks et al. | 24/662 X |

* cited by examiner

*Primary Examiner*—Lloyd A. Gall
(74) *Attorney, Agent, or Firm*—Notaro & Michalos P.C.

(57) ABSTRACT

A locking apparatus attaches a key to a writing instrument. The locking apparatus comprises a barrel having a top end and a bottom end. The top end has a top opening with a first diameter. The second end is attached to the writing instrument. A bore extends inwardly from the top opening. The bore has a second diameter which is larger than the first diameter. A step is formed in the barrel at top of the bore. A post has an upper section and a lower section. The lower section is slidably engaged in the bore. A plurality of tabs is pivotally connected to the lower section of the post. The tabs extend outwardly from the post so that tabs impinge the step. A ring is slidably supported in the bore. The ring has a center hole adapted to frictionally engage the tabs for removing the post from the barrel. A key is connected to the upper section of the post.

36 Claims, 7 Drawing Sheets

LOCKING APPARATUS FOR A KEY HOLDER

FIELD AND BACKGROUND OF THE INVENTION

The present invention relates generally to the field of locking devices, and in particular to the field of locking devices for a key holder.

Keys are common items used in everyday life. People carry their keys with them at all times. A variety of key holder designs have been available. However, none of the prior art allows a key to be connected to a key holder by the locking device of the present invention.

The construction of the prior art made attaching and removing key s difficult tasks involving numerous steps. These former key holders used complicated mechanisms comprised of intricate parts susceptible to easy breakage.

Further, none of the prior art allowed for efficient use of limited space in a pocket or bag. They were often awkward and unwieldy and consumed considerable space resulting in little or no space for other items. The former key holders, moreover, had a limited utility since they served the single obvious function—maintaining keys.

U.S. Pat. No. 4,984,442 is directed to a key holder that has a removable sliding pin with an annular notch on its top end and an aperture for holding a key ring on its bottom end. The body of the key holder includes a bottom vertical bore which receives the top end of the pin and a continuous internal passage formed of a first slot which is perpendicular to the bore, a second slot which is above the first slot and also perpendicular to the bore and an open longitudinal recess along the side of the body which extends from the first slot to the second slot. A "J"-shaped plunger is slidably mounted in the internal passage and is accessible from the recess. The plunger engages the notch of the pin so that the pin cannot slide out of the bore. An end cap protrudes from the side opposite the recess and is attached to the plunger by a spring coil. The pin is released by pressing the end cap inward so that the plunger moves in a lateral direction away from the pin.

In addition, U.S. Pat. No. 5,457,976 is for a key holder which operates by pressing down a button that protrudes from a top opening of the housing to release a locked cylindrical rod with an attached key ring from the housing.

A key retainer formed of a steel rod which is inserted into a cap having a magnetized cylindrical cavity is disclosed in U.S. Pat. No. 3,621,690. The rod is held in the cavity by magnetic attraction to the cavity wall. Ball chains for attaching keys are connected to the opposite ends of the rod and cap.

U.S. Pat. No. 5,031,430 discloses a key holder having an upper part that is rotatably attached to a bottom part by a pin. The upper part has an elongated opening for retaining a key ring. When the upper part and bottom part are rotated relative to the other, a concealed gap formed beneath the opening becomes exposed allowing a key to be either attached or removed from the elongated opening.

Further, U.S. Pat. No. 4,407,148 is directed to a key holder consisting of an open-ended key ring removably attached to a "C"-shaped hollow case. The key ring has a gap defined by two facing tips. The case has two notches on opposite sides of its exterior top wall. The tips of the key ring enter the apertures. A plunger is slidably mounted inside the case. A pair of locking ribs extend perpendicular from the top end of the plunger near the apertures. The locking ribs press the tips of the ring against the notches to secure the key ring to the case. The key ring is removed from the case by sliding the plunger so that the locking ribs disengage the tips.

Similarly, U.S. Pat. No. 3,362,201 is directed to a key holder which includes a casing having two apertures located at opposite sides for receiving an open-ended key ring, a plunger having a top loop that protrudes from the top of the casing and a bottom loop within the casing that is inserted through the key ring and a spring coil that forces the plunger upward so that the bottom loop latches against the key ring and prevents it from rotating. The key ring has a gap for inserting or removing a key. The gap is maintained within the casing. A key may be added to the key ring by pressing down on the top loop and rotating the key ring until the gap is exposed.

SUMMARY OF THE INVENTION

It is an object of the present invention to provide a a locking apparatus for attaching a key to a writing instrument. The locking apparatus of the invention includes a barrel having a top end and a bottom end, the top end having a top opening, the top opening having a first diameter, and the second end being attached to the writing instrument. A bore extends inwardly from the top opening and has a second diameter which is larger than the first diameter. A step is formed in the barrel at top of the bore and a post having an upper section and a lower section is provided, the lower section being slidably mounted in the bore. A plurality of tabs are pivotally connected to the lower section of the post and the tabs extend outwardly from the post so that the tabs impinge the step to hold the post in the barrel. A ring is slidably supported in the bore, the ring having a center hole adapted to engage the tabs and means are provided for connecting a key to the upper section of the post.

The post is engaged into the barrel by inserting the lower section of the post through the top opening. The tabs extend outwardly before entering the top opening. As the tabs enter the top opening, they are caused to move inwardly by the side wall of the top opening and remain pivoted inwardly as they travel through the latter.

The diameter of the bore is larger than the diameter of the top opening so that when the tabs exit the top opening and enter the bore, they automatically extend outwardly to their original position. The tabs, in their original extended position, impinge the step. Thus, the post remains locked in the barrel.

Disengagement of the post from the barrel occurs when the post is manually pushed down causing the lower section of the post to pass through the center opening of the ring. The tabs are caused to move inwardly when entering the center opening. The tabs press against the inside wall of the center opening to engage the ring. The engagement prevents the tabs from completely passing through the center opening.

The post, along with the engaged ring, is pulled vertically up through the bore. The engaged ring contacts the step which prevents the ring from moving further upward. By continuing to pull the post, the tabs enter the top opening of the barrel and the ring and tabs become disengaged from each other. Once disengaged, the ring falls by gravity to its original supported position in the bore. When the tabs transfer from the ring to the top opening, they are caused to remain pivoted inwardly by the top opening's side wall. Thus, the tabs cannot engage the step. The tabs are also caused to remain pivoted inwardly by the side wall when traveling through the top opening. The post is pulled up through the top opening until it is completely removed.

It should be understood that the locking apparatus is not limited to connecting a key to a writing instrument. The present invention can be used as a connector for other devices as well. For instance, the locking device can connect a key to a miniature flashlight, a cellular telephone case, pager case, among other various articles.

It is therefore an object of the invention to provide a key holder which is extremely easy and quick for locking a key thereon or releasing the same, which is extremely light in weight yet sturdy, highly durable and long lived.

Another object of the invention is to provide a key holder which is exceedingly simple in construction and inexpensive to manufacture.

Still another object of the invention is to provide a locking device for attaching a key holder to a writing instrument.

Still further another object of the invention is to provide a device for holding keys at one end and for writing at the other end.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
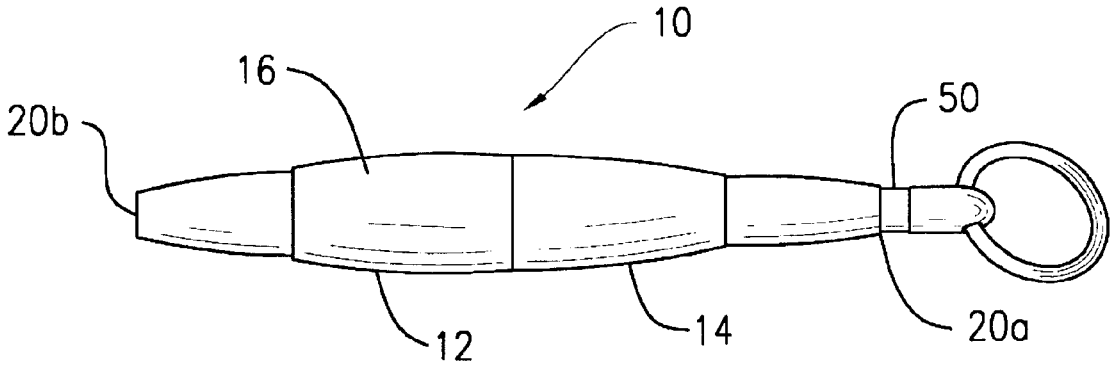
FIG. 1 is a front plan view of the device.

Referring now to the drawings, in which like reference numerals are used to refer to the same or similar elements, FIG. 1 shows barrel 10 which is provided with first opening 20*a* at the top :end of barrel and second opening 20*b* at the bottom end of barrel. Barrel 10 has outer shell 12 preferably formed of a metal. Barrel 10 also preferably has a short length, approximately in the range of three to four inches.

Barrel 10 is formed of top part 14 and bottom part 16. Any conventional connection technique can connect parts 14, 16. For example, either part can be formed with an internal or female thread (not shown) which mates with external or male thread (not shown)provided on the other part thereby locking parts 14, 16 together.

Bottom part 16 of barrel 10 receives a writing implement 18 (not shown), such as an ink cartridge, pencil lead, and so forth. The writing implement is not limited to a marking writing instrument but may also include a non-marking writing instrument, such as a stylus for use on a touch screen device. Writing implement 18 is short in length so that it can be received in bottom part 16. Tip of writing implement 18 extends through second opening 20*b* when device is used as a writing instrument. The tip may comprise the ball as found in a conventional ballpoint pen, a felt tip, a pencil lead or a non-marking stylus for use, e.g., with a PDA or the like.

Figure 2:
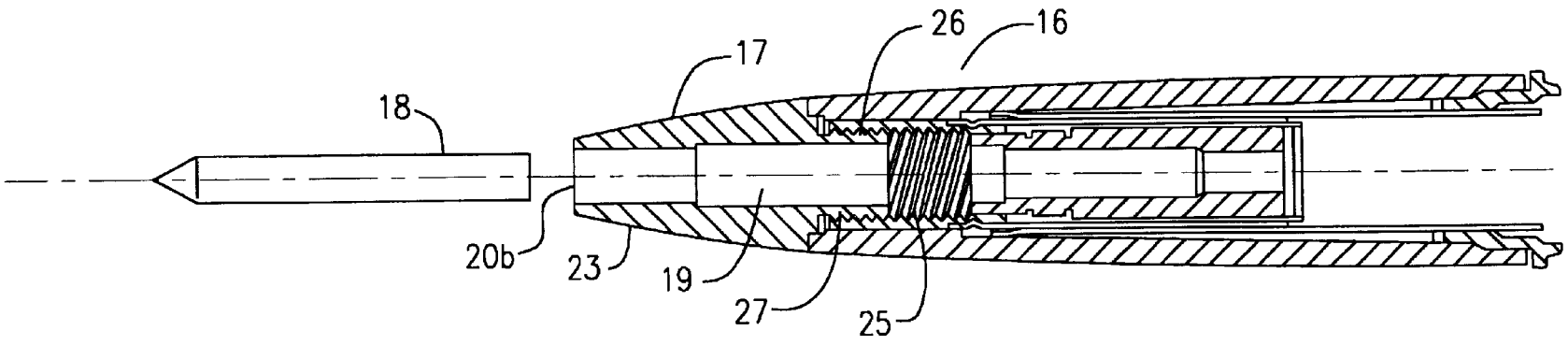
FIG. 2 is a sectional view of the cross-section of the bottom part of the device.

Referring to FIG. 2, bottom part 16 consists of neck 17 having a tapered point 23. Channel 19 extends longitudinally inward from second opening 20*b*.

Cylindrical sleeve 25 is axially mounted in channel 19 proximate second opening 20*b*. Cylindrical sleeve 25 is rotatably attached to neck 17 so that cylindrical sleeve 25 linearly moves in channel 19 when rotated relative to neck 17. Cylindrical sleeve 25 preferably has interior male thread 26 and which engages exterior female thread 27 of neck.

Writing implement 18 is front loaded into bottom part 16 of barrel by insertion through second opening 20*b*. Sleeve 25 frictionally engages end of writing implement 18.

To use the writing instrument, writing tip is retracted through second opening 20*b* by rotating neck 17 relative to sleeve 25. Neck 17 is rotated in opposite direction to retract writing tip inside neck 17 when writing instrument is not in use.

Other conventional techniques that are available and well within the understanding of those skilled in the art can be used for receiving the writing implement 18 in barrel 10.

Figure 3:
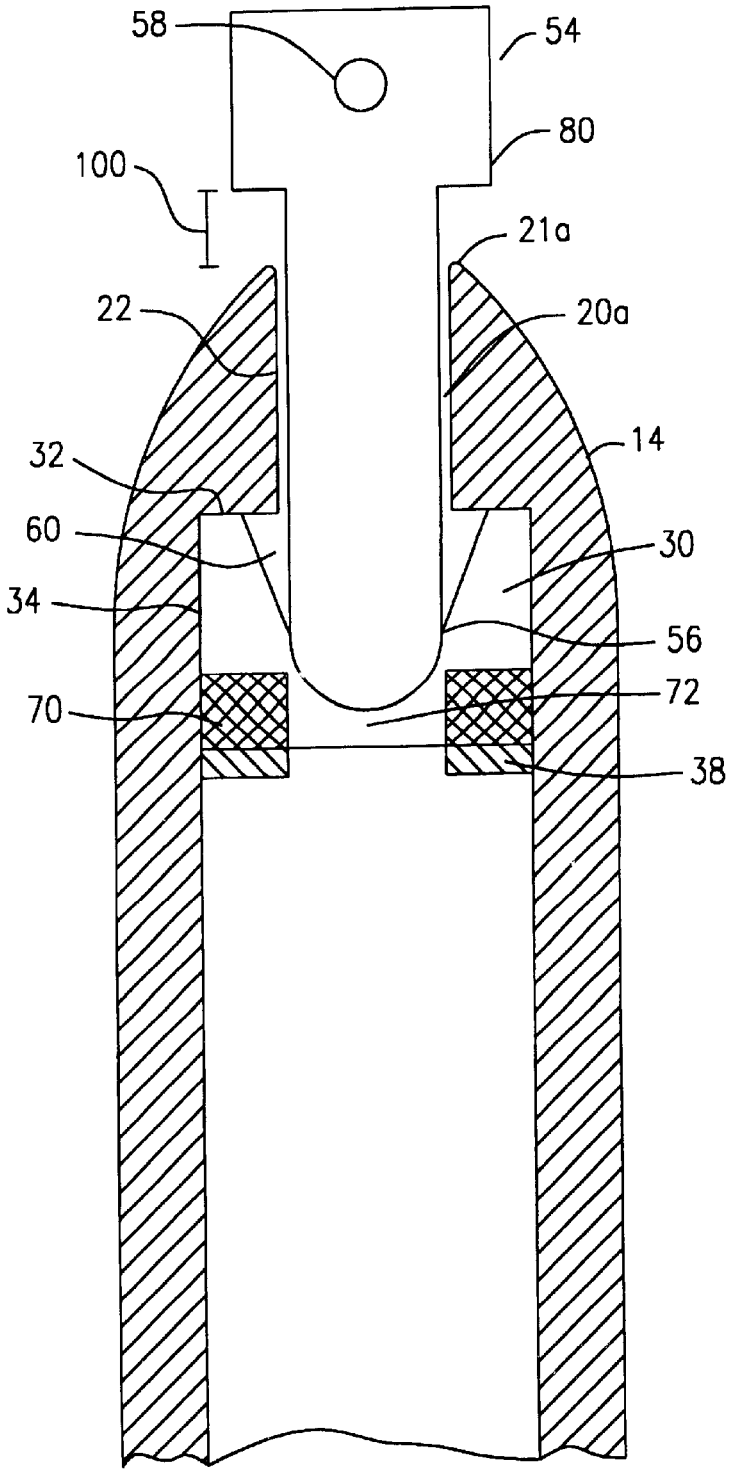
FIG. 3 is a sectional view of the cross-section of the top part of the device.

Referring to FIG. 3, top part 14 of barrel, receives post 50 for securing keys (not shown) to barrel 10. First opening 20*a* is defined by rim 21*a* and sidewall 22 proximate the top end of barrel 10. Inner bore 30 extends from and is axially aligned with first opening 20*a*. Inner bore 30 is defined by top wall 32 and interior bore sidewall 34. Top wall 32 forms a step which separates inner bore 30 from first opening 20*a*. Inner bore 30 has a greater diameter than first opening 20*a*.

Ring 70 having center opening 72 is supported in inner bore 30. Circular lip 38 preferably extends outward from interior sidewall 34 for supporting ring 70. Ring 70 has a diameter which is substantially the same as the diameter of inner bore 30 but which permits ring 70 to be slidably movable in a longitudinal direction in inner bore 30. Ring 70 is preferably formed of metal.

Post 50 has exterior wall 52, upper section 54 and lower section 56. Upper section 54 has an aperture 58 for receiving key ring (not shown). Key ring comprises a conventional split key ring which is adapted for receiving one or more keys.

Lower section 56 of post 50 preferably has a round surface. The diameter of lower section 56 is substantially the same as the diameter of central opening 72 of ring 70.

Flexible tabs 60, preferably two, extend outwardly from exterior wall 52 proximate lower section 56 of post. Tabs 60 are adapted to move inwardly toward post 50 when pressed.

Tabs 60 are preferably formed by an upside down U-shaped notch formed in exterior wall of post 50. Tabs are also preferably spaced apart by 180 degrees around post 50. Tabs 60 may be formed of a thin resilient plastic material such as a high density polyurethane or an acrylic plastic.

Post 50 is received and secured in barrel 10 in the following manner. Lower section 56 of post passes through first opening 20*a*. The diameter of lower section 56 is substantially the same as the diameter of first opening 20*a* so that tabs 60 are pressed inward by sidewall 22.

Tabs 60 extend outwardly when they exit first opening 20*a* and enter inner bore 30. Tabs 60 in extended position impinge top wall 32 thereby preventing post 50 from being pulled upward through first opening 20*a*.

Upper section 54 of post 50 preferably has flange 80 which extends circumferentially outward from exterior wall of post. Flange 80 is located at a selected distance 100 from rim 21*a* when tabs 60 impinge top wall 32. When post is moved downward for disengagement, flange 80 contacts rim 21*a* and prevents any further longitudinal movement of post 50. The selected distance 100 is such so that when post 50 is moved and flange 80 contacts rim 21*a*, tabs 60 engage with ring 70.

Figure 4A:
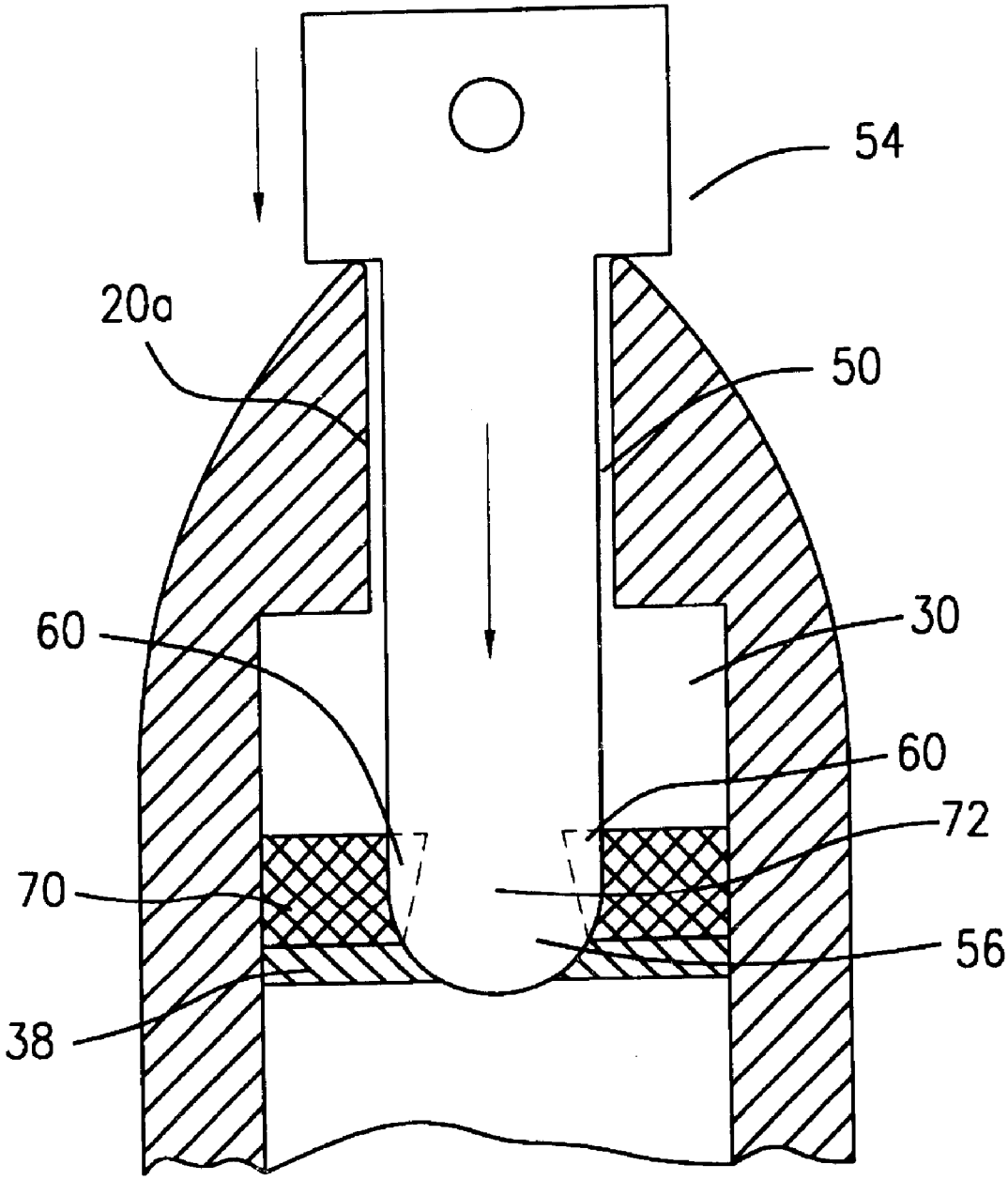
FIGS. 4*a, b, c* are sectional views showing the removal of the post from the device.

Referring to FIG. 4*a*, post 50 is disengaged from barrel 10 by pressing, down upper section 54 of post 50 so that lower section 56 passes through central opening 72 of ring. Tabs 60 enter central opening 72 and move inwardly. Tabs 60 press against side wall of central opening 72 to engage ring 70.

Figure 4B:
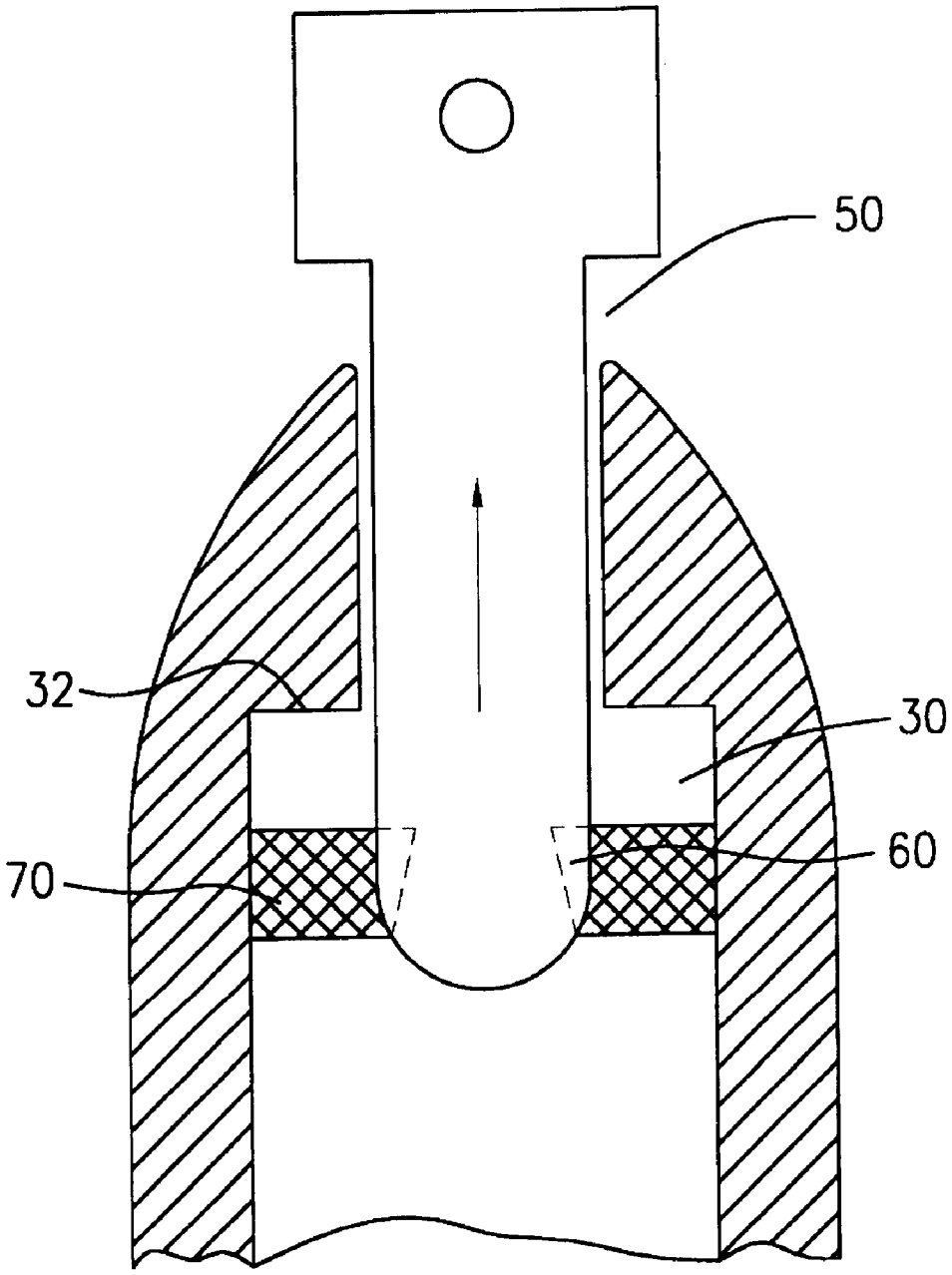

Referring,to FIG. 4*b*, post 50 is pulled up causing tabs 60 and engaged ring 70 to travel upwardly through bore 30.

Figure 4C:
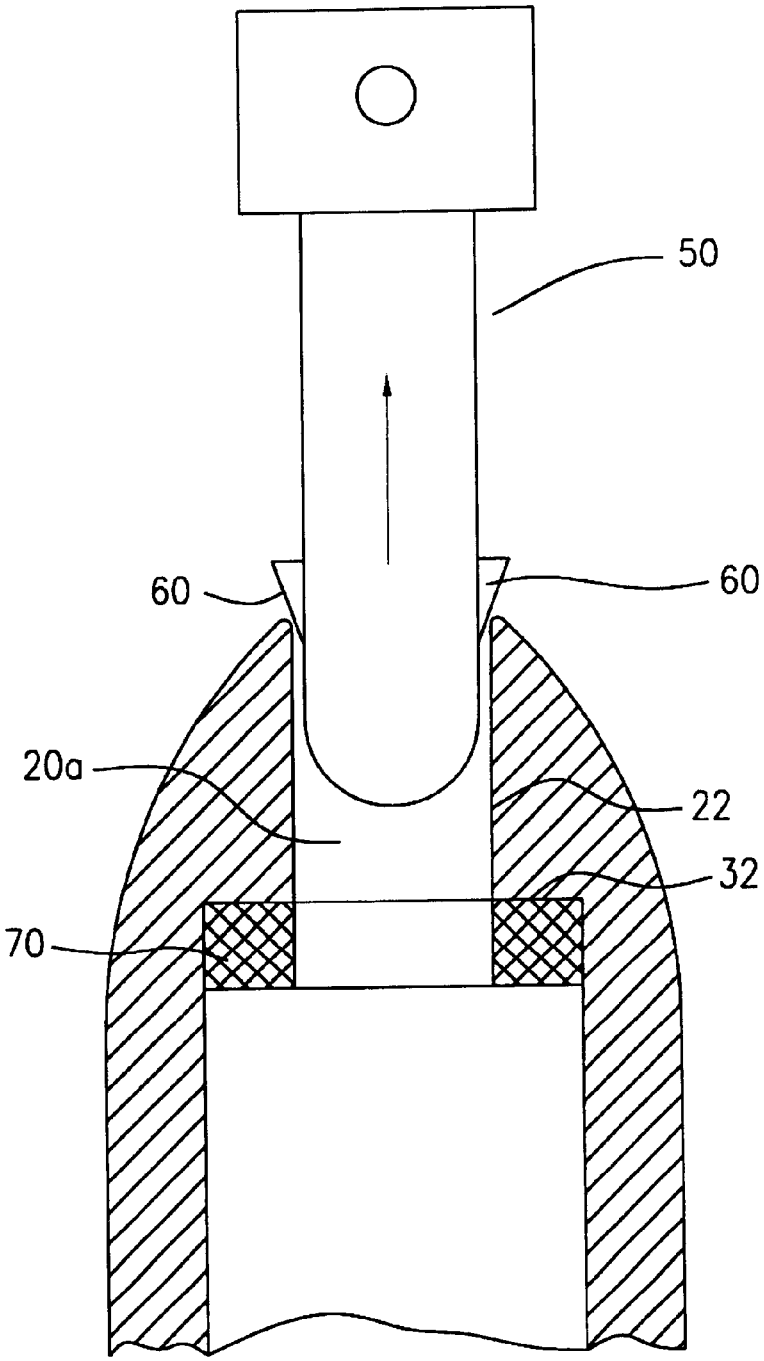

Referring to FIG. 4*c*, ring 70 contacts wall 32 so that ring 70 and tabs become disengaged as post 50 continues upwardly. As tabs 60 enter top opening 20*a*, they are caused to remain pivoted inwardly by sidewall 22 until completely exiting first opening 20*a*.

Figure 5:
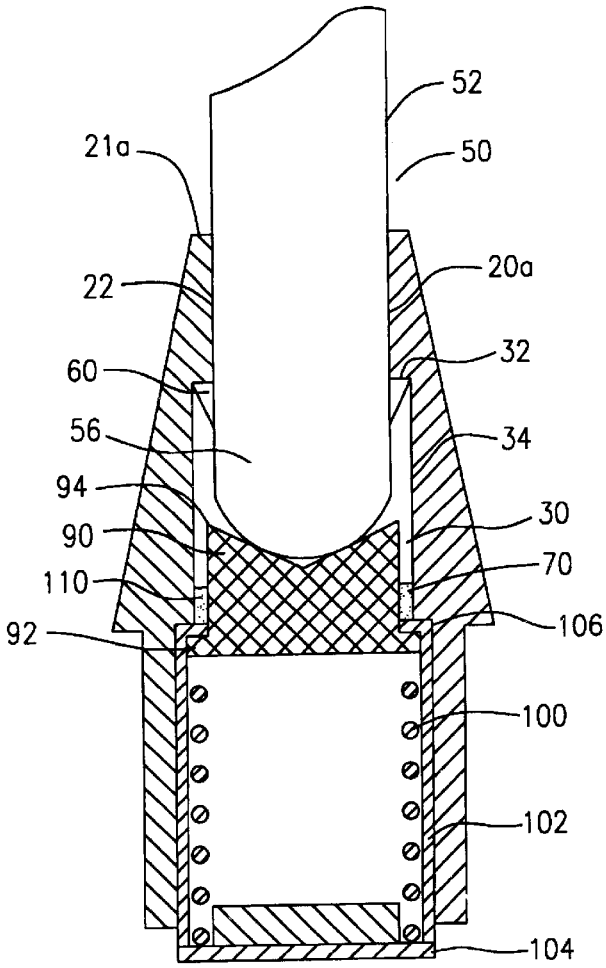
FIG. 5 is a sectional view of a second embodiment of the device.

Referring to FIG. 5, a second embodiment of the instant invention includes a plunger-spring assembly which allows tabs 60 to remain fixed against top wall 32 when device is in locked position so that post 50 cannot move loosely in inner bore 30. Plunger 90 is slidably received in inner bore 30. Plunger 90 has foot 92 which extends circumferentially outward from base of plunger 90. Plunger 90 has concave depression 94 on its top surface for engaging post 50.

Foot 92 rests on a biasing means 100 elastically mounted in bore 30. Biasing means 100 exerts an upward force on plunger 90. Biasing means may be in form of a spring or a bladder.

Biasing means 100 is preferably mounted in retainer can 102 having top opening 104 which is defined by circular ledge 106 and endcap 104 which covers base of can 102.

Foot 92 of plunger is positioned in retainer can 102 beneath circular ledge 106. Biasing means 100 biases plunger 90 to extend through top opening 104 of retainer can 102 and foot 92 to impinge bottom surface of circular ledge 106.

Passage 110 is formed between side wall of plunger 90, sidewall 34 of core 30 and top surface of circular ledge 106. Ring 70 rests in passage 110 on circular ledge 106. Ring 70 surrounds plunger 90 when device is in a locked position, i.e., tabs 60 impinge top wall 32 of inner bore 30.

Lower section 56 of post 50 engages concave depression 94 of plunger 90. Biasing means 100 biases plunger 90 in an upward direction through center opening 72 of ring 70. Post 50 is forced contemporaneously upward by plunger 90 thereby causing tabs 60 to impinge top wall 32. The upward force of biasing means 100 causes tabs 60 to remain pressed against top wall 32 so that post 50 cannot move freely in bore 30.

To disengage post 50, upper section 54 of. post 50 is pressed down causing downward movement of plunger 90 and compression of biasing means 100. Tabs 60 enter central opening 72 of ring 70. Sidewall of central opening 72 presses tabs 60 inwardly thereby causing ring 70 and tabs to become engaged. Post 50 is then removed in the same manner as described above for preferred embodiment of the instant invention.

Figure 6:
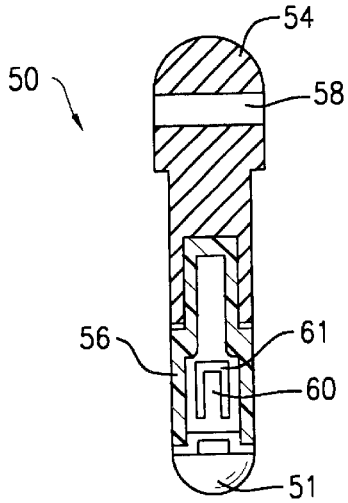
FIG. 6 is a detail of the post.

FIG. 6 illustrates details of one embodiment of post 50 which has a metal cap or upper section 54 that received a plastic, e.g., nylon, lower section 56. Lower section 56 is hollow and has U-shaped slots 61 that define each tab 60. To help insert post 50 into the barrel, it also has a round metal nose piece 51 that is fixed to the lower end of lower section 56.

While a specific embodiment of the invention has been shown and described in detail to illustrate the application of the principles of the invention, it will be understood that the invention may be embodied otherwise without departing from such principles.

What is claimed is:

1. A locking apparatus for attaching a key to a writing instrument, the locking apparatus comprising:

a barrel having a top end and a bottom end, the top end having a top opening, the top opening having a first diameter, the bottom end being attached to the writing instrument;

a bore extending inwardly from the top opening, the bore having a second diameter which is larger than the first diameter;

a step formed in the barrel at a top of the bore;

a post having an upper section and a lower section, the lower section slidably mounted in the bore;

a plurality of tabs movably connected to the lower section of the post, the tabs extending outwardly from the post for engaging the step to retain the post in the barrel;

a ring slidably supported in the bore, the ring having a center hole adapted to engage and move the tabs for removing the post from the barrel; and a means for connecting a key to the upper section of the post.

2. The locking apparatus as claimed in claim 1, wherein the means for connecting comprises an aperture in the upper section.

3. The locking apparatus as claimed in claim 2, including a key ring received in the aperture.

4. The locking apparatus as claimed in claim 1, further comprising an annular lip extending outwardly from a side wall of the bore for retaining the ring in the bore.

5. The locking apparatus as claimed in claim 1, further comprising:

a plunger extending through the center hole of the ring for engaging the lower section of the post; and biasing means coupled to the plunger for biasing the post in a direction so that the tabs remain engaged with the step.

6. The locking apparatus as claimed in claim 5, wherein the plunger has a concave surface for engaging the post.

7. The locking apparatus as claimed in claim 5, wherein the plunger has an annular foot extending circumferentially outwardly from the plunger.

8. The locking apparatus as claimed in claim 7, further comprising:

a hollow, cylindrical housing located in the bore for holding the biasing means, the housing having a circular ledge and a housing opening in the housing defined by the circular ledge.

9. The locking apparatus as claimed in claim 8, wherein the ring rests on the circular ledge of the housing.

10. The locking apparatus as claimed in claim 8, wherein the plunger extends through the housing opening and the foot of the plunger impinges under the circular ledge.

11. The locking apparatus as claimed in claim 1, wherein the barrel has a rim that defines the top opening, and the post further comprising:

a flange extending circumferentially outwardly and proximate the upper section of the post, the flange having an outer diameter greater than the first diameter, the flange being spaced from the rim by a selected distance when the tabs are engaged with the step so that when the post is moved and the flange contacts the rim, the tabs engage with the ring.

12. The locking apparatus as claimed in claim 1, wherein the tabs are formed of plastic.

13. The locking apparatus as claimed in claim 1, wherein the tabs are defined by a U-shaped notch on a surface of the post.

14. The locking apparatus as claimed in claim 1, wherein the tabs are spaced 180 degrees apart around the post.

15. The locking apparatus as claimed in claim 1, wherein the ring has an outer diameter approximately equal to the second diameter.

16. The locking apparatus as claimed in claim 1, wherein the post has a diameter approximately equal to the first diameter.

17. The locking apparatus as claimed in claim 1, wherein the barrel is comprised of two parts that are detachably connected to each other.

18. The locking apparatus as claimed in claim 1, wherein the top end of the barrel has a tapered conical shape.

19. A locking apparatus for attaching a key to a writing instrument, the locking apparatus comprising:

a barrel having a top end and a bottom end, the top end having a top opening, the top opening having a first diameter, the second end being attached to the writing instrument;

a bore extending inwardly from the top opening, the bore having a second diameter which is larger than the first diameter;.

a step formed in the barrel at a top of the bore;

a post having an upper section and a lower section, the lower section slidably engaged in the bore;

a plurality of tabs movably connected to the lower section of the post, the tabs extending outwardly from the post for engaging the step to retain the post in the barrel;

a ring slidably supported in the bore, the ring having a center hole adapted to engage and move the tabs for removing the post from the barrel;

a plunger extending upwardly through the center hole of the ring for supporting the lower section of the post, the plunger having an annular foot extending circumferentially outward from the plunger;

a biasing means coupled to the plunger for biasing the post in a direction so that the tabs remain engaged with the step;

a hollow, cylindrical housing located in the bore for holding the biasing means, the housing having a circular ledge, and a housing opening defined by the circular ledge wherein the upper part of the plunger extends through the housing opening and the foot of the plunger impinges under the circular ledge; and a means for connecting a key to the upper section of the post.

20. A connector comprising:

a barrel having a top end, the top end having an opening with a first diameter;

a bore extending inwardly from the opening, the bore having a second diameter which is larger than the first diameter;

a step formed in the barrel at the top of the bore;

a post having an upper section and a lower section, the lower section slidably engaged in the bore;

a plurality of tabs movably connected to the lower section of the post, the tabs extending outwardly from the post for engaging the step to retain the post in the barrel; and;

a ring slidably supported in the bore, the ring having a center hole adapted to engage and move the tabs for removing the post from the barrel.

21. The connector as claimed in claim 20, further comprising an annular lip extending outwardly from a side wall of the bore for retaining the ring in the bore.

22. The connector as claimed in claim 20, further comprising:

a plunger extending through the center hole of the ring for engaging the lower section of the post; and a biasing means coupled to the plunger for biasing the post in a direction so that the tabs remain engaged with the step.

23. The connector as claimed in claim 22, wherein the plunger has a concave surface for engaging the post.

24. The connector as claimed in claim 22, wherein the plunger has an annular foot extending circumferentially outwardly from the plunger.

25. The connector as claimed in claim 24, further comprising:

a hollow, cylindrical housing located in the bore for holding the biasing means, the housing having a circular ledge and a housing opening in the housing defined by the circular ledge.

26. The connector as claimed in claim 25, wherein the ring rests on the circular ledge of the housing.

27. The connector as claimed in claim 25, wherein the plunger extends through the housing opening and the annular foot of the plunger impinges under the circular ledge.

28. The connector as claimed in claim 20, wherein the barrel has a rim that defines the top opening, and the post further comprises:

a flange extending circumferentially outwardly and proximate the upper section of the post, the flange having an outer diameter greater than the first diameter, the flange being spaced from the rim by a selected distance when the tabs are engaged with the step so that when the post is moved and the flange contacts the rim, the tabs engage the ring.

29. The connector as claimed in claim 20, wherein the tabs are formed of plastic.

30. The connector as claimed in claim 20, wherein the tabs are defined by a U-shaped notch on a surface of the post.

31. The connector as claimed in claim 20, wherein the tabs are spaced 180 degrees apart around the post.

32. The connector as claimed in claim 20, wherein the ring has an outer diameter approximately equal to the second diameter.

33. The connector as claimed in claim 20, wherein the post has a diameter approximately equal to the first diameter.

34. A key holder and writing instrument assembly comprising:

a barrel having a top end and a bottom end, the top end having a top opening with a first diameter, the bottom end having a bottom opening;

a bore extending inwardly from the top opening, the bore having a second diameter which is larger than the first diameter;

a step formed in the barrel at the top of the bore;

a post having an upper section and a lower section, the lower section slidably engaged in the bore;

a plurality of tabs movably connected to the lower section of the post, the tabs extending outwardly from the post for engaging the step to retain the post in the barrel;

a ring slidably supported in the bore, the ring having a center hole adapted to engage and move the tabs for removing the post from the barrel;

a means for connecting a key to the upper section of the post; and a writing implement mounted in the barrel, the writing implement having a tip that extends through the bottom opening.

35. The key holder and writing instrument assembly as claimed in claim 34, wherein the writing implement is rotatable relative to the barrel for actuating axial movement of the writing implement relative to the barrel.

36. The key holder and writing instrument assembly as claimed in claim 34, wherein the writing implement is received into a sleeve within the barrel, the sleeve having an inner spiral thread and being adapted for receiving the writing implement; the writing implement further including a tip at one end of the writing implement which is shaped to be extended and retracted through the bottom opening.

* * * * *